US006708761B2

(12) United States Patent
George et al.

(10) Patent No.: US 6,708,761 B2
(45) Date of Patent: Mar. 23, 2004

(54) APPARATUS FOR ABSORBING A SHOCK AND METHOD FOR USE OF SAME

(75) Inventors: Flint R. George, Flower Mound, TX (US); John D. Burleson, Denton, TX (US); Roger L. Schultz, Aubrey, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 22 days.

(21) Appl. No.: 10/010,357

(22) Filed: Nov. 13, 2001

(65) Prior Publication Data

US 2003/0089497 A1 May 15, 2003

(51) Int. Cl.[7] ..... E21B 12/07
(52) U.S. Cl. ..... 166/297; 175/321; 188/376
(58) Field of Search ..... 166/381, 297, 166/55.1; 175/4.54, 299, 301, 321, 325.5, 325.7; 188/376

(56) References Cited

U.S. PATENT DOCUMENTS

| | | | | | |
|---|---|---|---|---|---|
| 3,706,344 | A | | 12/1972 | Vann | 166/297 |
| 3,759,351 | A | * | 9/1973 | Purple | 188/376 |
| 4,440,273 | A | | 4/1984 | Butler | 188/315 |
| 4,512,406 | A | * | 4/1985 | Vann et al. | 166/297 |
| 4,693,317 | A | * | 9/1987 | Edwards et al. | 166/378 |
| 4,911,251 | A | | 3/1990 | George et al. | 175/4.54 |
| 4,932,471 | A | | 6/1990 | Tucker et al. | 166/64 |
| 5,083,623 | A | | 1/1992 | Barrington | 175/321 |
| 5,090,755 | A | * | 2/1992 | Garnweidner | 188/376 |
| 5,133,419 | A | | 7/1992 | Barrington | 175/321 |
| 5,366,013 | A | | 11/1994 | Edwards et al. | 166/297 |
| 5,490,563 | A | * | 2/1996 | Wesson et al. | 166/297 |
| 6,109,355 | A | | 8/2000 | Reid | 166/380 |
| 6,206,155 | B1 | * | 3/2001 | Schneider | 188/376 |

* cited by examiner

*Primary Examiner*—William Neuder
(74) *Attorney, Agent, or Firm*—Lawrence R. Youst

(57) ABSTRACT

An apparatus (60) for absorbing a shock comprises a first tubular member (62) and a second tubular member (80) that are slidable positioned relative to one another. A plurality of layers (94–104) of energy absorbing members (88) extend radially from the second tubular member (80) such that movement of the second tubular member (80) in a first direction relative to the first tubular member (62) sequentially deforms the layers (94–104) of energy absorbing members (88). As the layers (94–104) are sequentially deformed, a subsequent layer (96) of energy absorbing members (88) begins to deform before the previous layer (94) of energy absorbing members (88) is completely deformed. The deformation of the energy absorbing members (88) absorbs the shock.

49 Claims, 4 Drawing Sheets

APPARATUS FOR ABSORBING A SHOCK AND METHOD FOR USE OF SAME

TECHNICAL FIELD OF THE INVENTION

This invention relates, in general, to absorbing a shock between two tubular members and, in particular, to an apparatus for absorbing a shock between two tubular members using a plurality of layers of energy absorbing members that are sequentially deformed.

BACKGROUND OF THE INVENTION

Without limiting the scope of the present invention, its background will be described with reference to perforating a subterranean formation using shaped charge perforating guns, as an example.

After drilling the section of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore. To produce fluids into the casing string, hydraulic opening or perforation must be made through the casing string, the cement and a short distance into the formation.

Typically, these perforations are created by detonating a series of shaped charges located within the casing string that are positioned adjacent to the formation. Specifically, numerous charge carriers are loaded with shaped charges that are connected with a detonating device, such as detonating cord. The charge carriers are then connected within a tool string that is lowered into the cased wellbore at the end of a tubing string, wireline, slick line, coil tubing or the like. Once the charge carriers are properly positioned in the wellbore such that the shaped charges are adjacent to the formation to be perforated, the shaped charges are detonated. Upon detonation, each shaped charge creates a jet that blasts through a scallop or recess in the carrier, creates a hydraulic opening through the casing and cement and then penetrates the formation forming a perforation therein.

It has been found, however, that a shock wave may be generated that travels upwardly through the tools of the tool string when the shaped charge perforating guns are fired. This shock wave may damage certain tools in the tool string. In addition, it has been found that the firing bar used to contact the firing head of the perforating guns may be forced back uphole after the shaped charge perforating guns are fired. The firing bar may then damage equipment in the wellhead. Further, it has been found that once the perforating process is complete and the shaped charge perforating guns are released, they may damage the temporary plug that is commonly located within the casing below the formation that was perforated.

A need has therefore arisen for an apparatus that can be installed within the tool string that can absorb the shock wave generated by firing the shaped charge perforating guns. A need has also arisen for such an apparatus that can absorb the shock of the firing bar contacting wellhead equipment if the firing bar is forced back uphole after the shaped charge perforating guns are fired. Further, a need has arisen for such an apparatus that can absorb the shock of the shaped charge perforating guns contacting the temporary plug after the shaped charge perforating guns are released.

SUMMARY OF THE INVENTION

The present invention disclosed herein comprises a shock absorber that can be installed within a tool string to prevent damage to other downhole equipment caused by shocks. For example, the shock absorber of the present invention may be installed within the tool string to absorb the shock wave generated by firing shaped charge perforating guns. Likewise, the shock absorber of the present invention may be installed within the tool string to absorb the shock of the shaped charge perforating guns contacting the temporary plug after the shaped charge perforating guns are released. The shock absorber of the present invention may also be installed at the wellhead to absorb the shock of the firing bar if it is forced back uphole after the shaped charge perforating guns are fired. Additionally, the shock absorber of the present invention, may be used between virtually any downhole tools or between any two devices that may encounter significant one time shocks.

The shock absorber of the present invention comprises first and second tubular members that are slidably positioned relative to one another. A plurality of layers of energy absorbing members extends radially from the second tubular member such that movement of the second tubular member in a first direction relative to the first tubular member sequentially deforms the layers of energy absorbing members, thereby absorbing the shock.

In one embodiment of the shock absorber of the present invention, the second tubular member is positioned interiorly of the first tubular member. In another embodiment, the second tubular member is positioned exteriorly of the first tubular member. In one embodiment of the shock absorber of the present invention, the energy absorbing members are positioned between the first and second tubular members. The energy absorbing members may extend radially outwardly from the second tubular member or may extend radially inwardly from the second tubular member.

In one embodiment of the shock absorber of the present invention, each layer of energy absorbing members includes a plurality of shear pins. In another embodiment, each layer of energy absorbing members is a shear ring. In either embodiment, a subsequent layer of energy absorbing members may begin to deform before a previous layer of energy absorbing members is completely deformed when the second tubular member moves in the first direction relative to the first tubular member to allow for a smooth shock absorption.

In one embodiment of the shock absorber of the present invention, when the second tubular member moves in either longitudinal direction relative to the first tubular member, the energy absorbing members in adjacent layers are sequentially deformed. In this embodiment, first and second pluralities of layers of energy absorbing members extend radially from the second tubular member such that movement of the second tubular member in a first direction relative to the first tubular member sequentially deforms the layers of energy absorbing members of the first plurality of layers of energy absorbing members. Likewise, movement of the second tubular member in a second direction relative to the first tubular member sequentially deforms the layers of energy absorbing members of the second plurality of layers of energy absorbing members, thereby absorbing a shock in either direction.

The method of the present invention involves slidably positioning a first tubular member relative to a second tubular member, radially extending a plurality of layers of energy absorbing members from the second tubular member and sequentially deforming the layers of energy absorbing members as the second tubular member is moved in a first direction relative to the first tubular member, thereby absorbing the shock.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
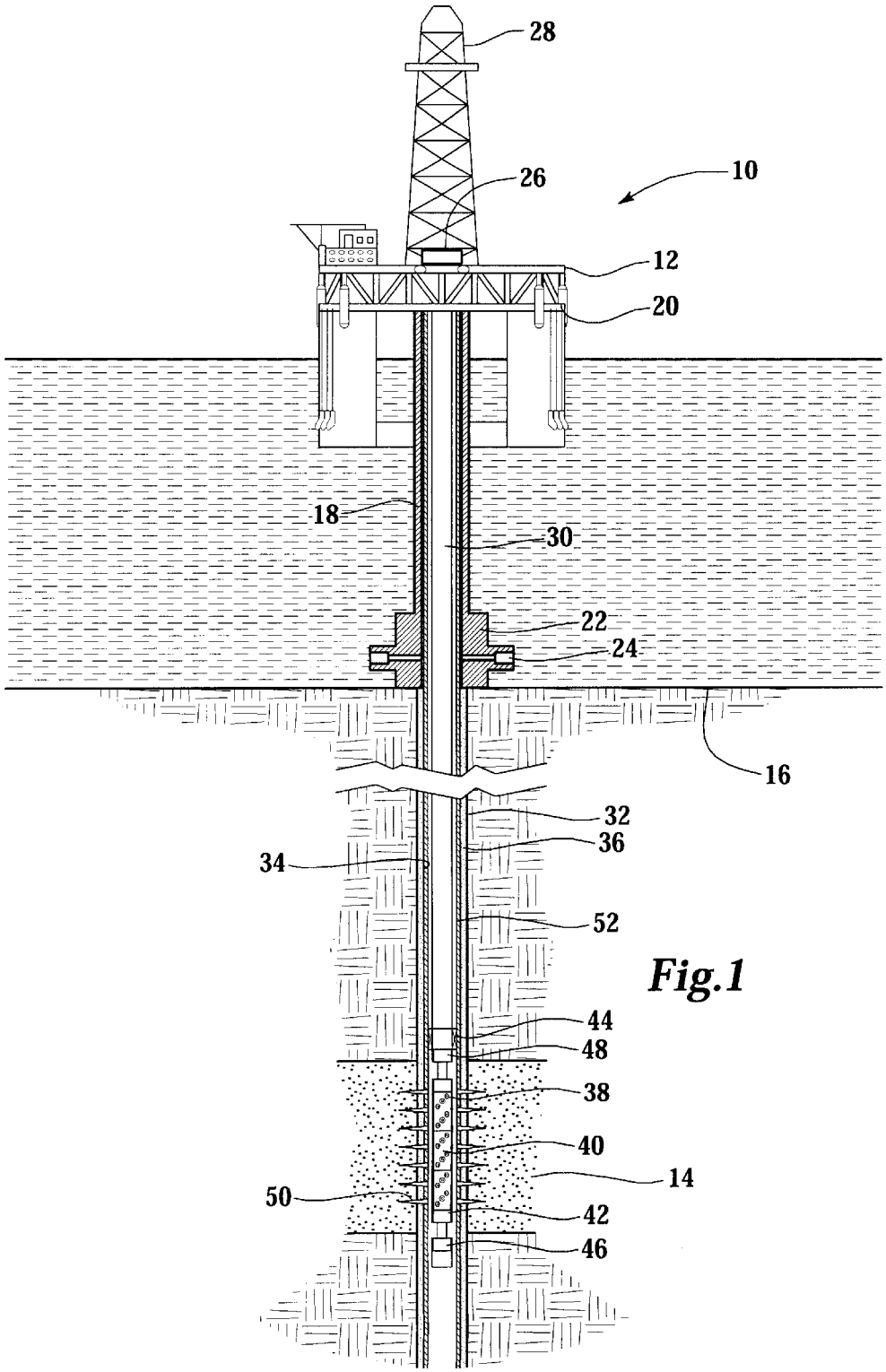
FIG. 1 is a schematic illustration of an offshore oil and gas platform operating a pair of apparatuses for absorbing a shock of the present invention.

Referring initially to FIG. 1, a pair of shock absorbers of the present invention operating from an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including subsea blow-out preventers 24. Platform 12 has a hoisting apparatus 26 and a derrick 28 for raising and lowering pipe strings such as work sting 30.

A wellbore 32 extends through the various earth strata including formation 14. A casing 34 is cemented within wellbore 32 by cement 36. Work string 30 includes various tools such as shaped charge perforating guns 38, 40, 42, a packer 44 and shock absorbers 46, 48. When it is desired to perforate formation 14, work string 30 is lowered through casing 34 until shaped charge perforating guns 38, 40, 42 are positioned adjacent to formation 14. Thereafter, shaped charge perforating guns 38, 40, 42 are sequentially fired such that the shaped charges are detonated. Upon detonation, the liners of the shaped charges form jets that create a spaced series of perforations 50 extending outwardly through casing 34, cement 36 and into formation 14.

When the shaped charge perforating guns 38, 40, 42 are fired, a shock wave may be generated that travels upwardly through the tools of work string 30 which may damage certain tools in work string 30. In the illustrated embodiment, shock absorber 48 absorbs this shock to prevent such damage. In addition, once the perforating process is complete, shaped charge perforating guns 38, 40, 42 may be released and allowed to fall down wellbore 32. Commonly there is a temporary plug (not pictured) located within casing 34 below formation 14. When shaped charge perforating guns 38, 40, 42 encounter the temporary plug, shaped charge perforating guns 38, 40, 42 may damage the temporary plug. In the illustrated embodiment, shock absorber 46 absorbs this shock to prevent such damage.

Even though FIG. 1 depicts a vertical well, it should be noted by one skilled in the art that the shock absorbers of the present invention are equally well-suited for use in deviated wells, inclined wells or horizontal wells. Also, even though FIG. 1 depicts an offshore operation, it should be noted by one skilled in the art that the shock absorbers of the present invention are equally well-suited for use in onshore operations. In addition, even though the shock absorbers of the present invention have been described with reference to absorbing shock during and following a perforating operation, those skilled in the art should recognize that the shock absorbers of the present invention are equally-well suited for absorbing shock between virtually any downhole tools or between any two devices that may encounter significant one time shocks.

Figure 2:
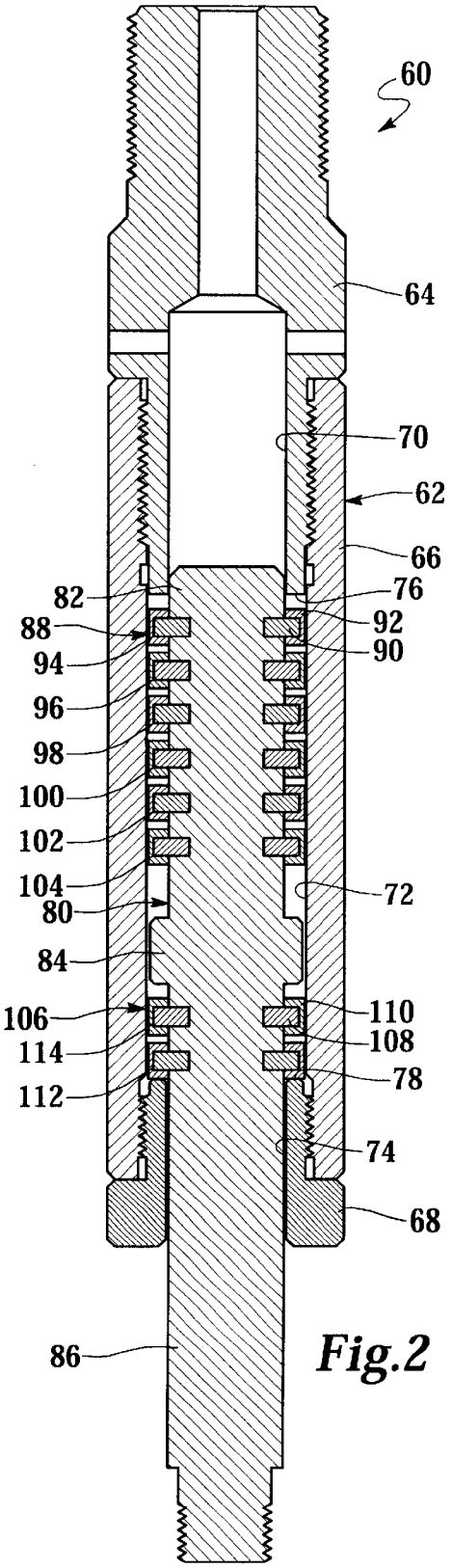
FIG. 2 is a half sectional view of an apparatus for absorbing a shock of the present invention prior to absorbing a shock.

Now referring to FIG. 2, therein is depicted a shock absorber of the present invention that is generally designated 60. Shock absorber 60 includes an axially extending, generally tubular outer housing 62. Outer housing 62 includes an upper connector 64 that is threadably attachable to another tool (not pictured). Outer housing 62 also includes a primary housing section 66 that is threadably coupled to upper connector 64. Threadably attached to the lower end of primary housing section 66 is an end cap 68. A longitudinal bore is defined within outer housing 62. Specifically, upper connector 64 defines upper bore 70, primary housing section 66 defines primary bore 72 and end cap 68 defines lower bore 74. Upper bore 70 and lower bore 74 have radially reduced inner diameters compared with primary bore 72. At the lower end of upper connector 64 is a shoulder 76 that separates upper bore 70 and primary bore 72. Likewise, at the upper end of end cap 68 is a shoulder 78 that separates lower bore 74 from primary bore 72.

It should be apparent to those skilled in the art that the use of directional terms such as top, bottom, above, below, upper, lower, upward, downward, etc. are used in relation to the illustrative embodiments as they are depicted in the figures, the upward direction being toward the top of the corresponding figure and the downward direction being toward the bottom of the corresponding figure. As such, it is to be understood that the downhole components described herein may be operated in vertical, horizontal, inverted or inclined orientations without deviating from the principles of the present invention.

Slidably positioned within outer housing 62 is an axially extending, generally tubular mandrel 80. Mandrel 80 includes an upper section 82 that is slidably received within upper bore 70 of outer housing 62. Mandrel 80 also includes an intermediate section 84 that is slidably received within primary bore 72 of outer housing 62. Mandrel 80 further includes a lower section 86 that is slidably received within lower bore 74 of outer housing 62 and is threadably attachable to another tool (not pictured). Extending radially outwardly from upper section 82 of mandrel 80 is a plurality of energy absorbing members 88. In the illustrated embodiment, each energy absorbing member 88 includes one or more shearable members 90 and one or more corresponding outer rings 92. For example, shearable members 90 may be a plurality of shear pins such that two or more of such shear pins are spaced circumferentially around upper section 82 of mandrel 80 in which case each shear pin includes its own outer ring 92. Alternatively, shearable members 90 may be shear rings, each of which circumferentially extends around upper section 82 of mandrel 80 and each of which has a corresponding outer ring 92. It should be noted by those skilled in the art that even through energy absorbing members 88 have been depicted as including two parts, shearable members 90 and outer rings 92, energy absorbing members 88 could alternatively be a single part wherein, for example, shearable members 90 and outer rings 92 are integral with one another.

Energy absorbing members 88 are positioned longitudinally along upper section 82 of mandrel 80 in a layer arrangement including layers 94–104. Accordingly, each layer 94–104 may include a plurality of shearable members or a single shearable member. Even though FIG. 2 has been depicted as having six layers 94–104, it should be understood by those skilled in the art that any number of layers of energy absorbing members 88 could alternatively be utilized those numbers being either greater than or less than six.

Extending radially outwardly from lower section 86 of mandrel 80 are additional energy absorbing members 106 that may be identical to energy absorbing members 88. Specifically, energy absorbing members 106 include shearable members 108 that may be shear pins or shear rings and outer rings 110. Energy absorbing members 106 are oriented longitudinally along lower section 86 of mandrel 80 in layers 112, 114.

In operation, when a shock is applied between outer housing 62 and mandrel 80 causing mandrel 80 to move upwardly relative to outer housing 62, outer rings 92 of layer 94 of energy absorbing members 88 contact shoulder 76. As mandrel 80 continues its upward movement relative to outer housing 62, shearable members 90 of layer 94 begin to deform and absorb some of the shock applied between mandrel 80 and outer housing 62.

Figure 3:
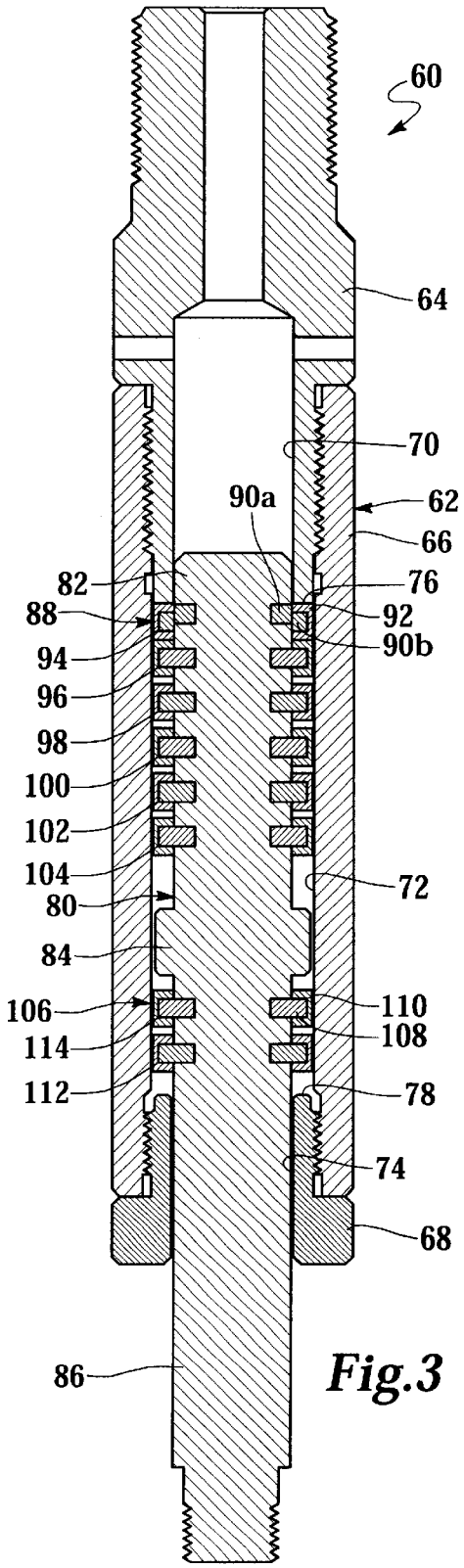
FIG. 3 is a half sectional view of an apparatus for absorbing a shock of the present invention after a portion of a shock has been absorbed.
Figure 4:
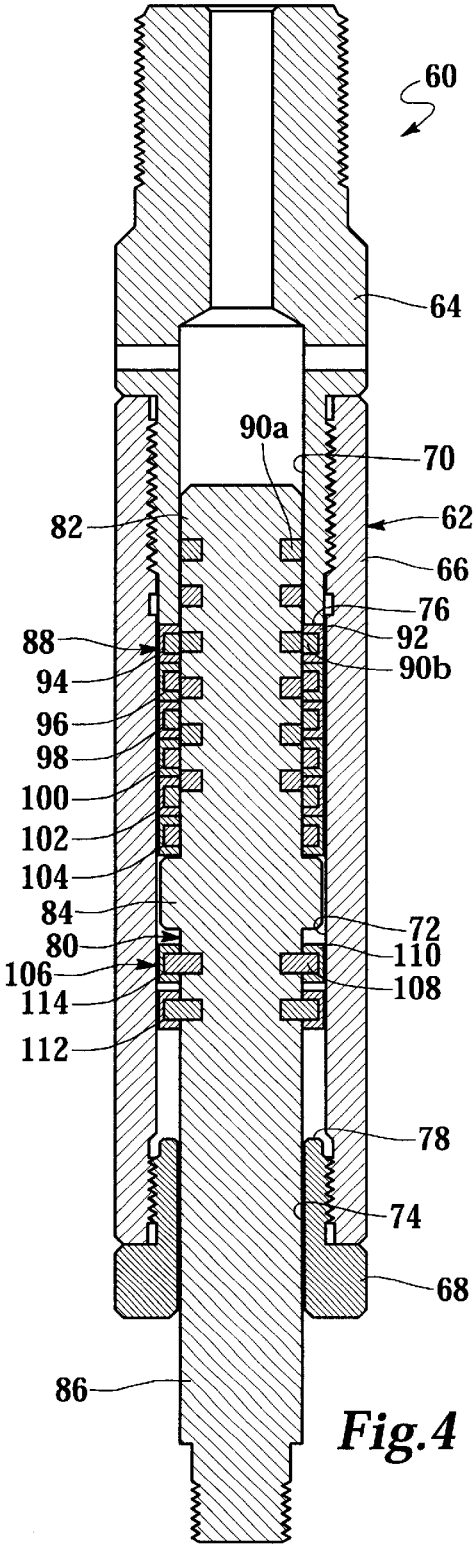
FIG. 4 is a half sectional view of an apparatus for absorbing a shock of the present invention after a shock has been absorbed.

As best seen in FIG. 3, before shearable members 90 of layer 94 of energy absorbing members 88 is completely deformed, outer rings 92 of layer 94 contact outer rings 92 of layer 96. The contact between adjacent layers of energy absorbing members 88 before respective shearable members 90 are completely deformed allows shock absorber 60 of the present invention to absorb the shock applied between mandrel 80 and outer housing 62 in a smooth manner without creating sequential impacts between outer housing 62 and mandrel 80. It should be noted, however, that the distance between the layers of energy absorbing members 88 could alternatively allow complete deformation of shearable members 90 of one layer of energy absorbing members 88 before shearable members 90 of a subsequent layer of energy absorbing members 88 begin to deform. In either case, energy absorbing members 88 are sequentially deformed beginning at layer 94 and progressing through subsequent layers 96–104 of energy absorbing members 88 until the entire shock between housing 62 and mandrel 80 is absorbed. As best seen in FIG. 4, the maximum amount of shock that can be absorbed by shock absorber 60 has been absorbed and all shearable members 90 in the various layers 94–104 of energy absorbing members 88 have been sheared. Importantly, it should be noted that the number of layers of energy absorbing members 88 as well as the strength of shearable members 90 may be selected based upon the expected shock to be absorbed by shock absorber 60 such that the entire expected shock may be absorbed without shearing all shearable members 90.

Figure 5:
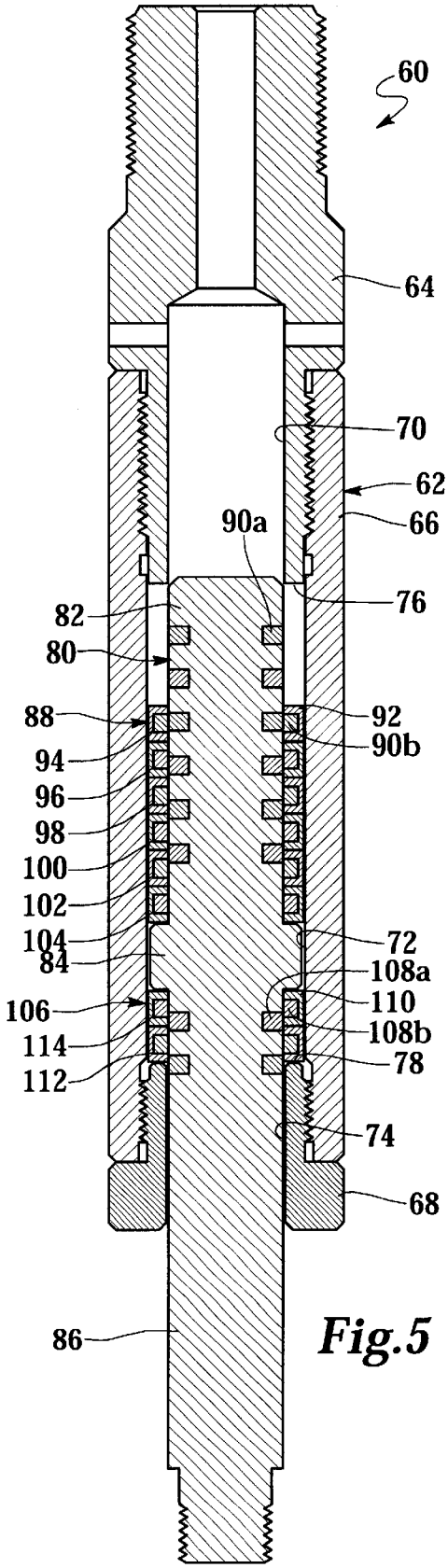
FIG. 5 is a half sectional view of an apparatus for absorbing a shock of the present invention after a shock has been absorbed.

In certain applications of shock absorber 60, after shock absorber 60 has absorbed the initial shock, mandrel 80 may travel downwardly relative to housing 62, for example, to carry the weight of the tool string below shock absorber 60. In this case, to avoid significant impact between mandrel 80 and outer housing 62 during this downward movement, energy absorbing members 106 are used. Specifically, when mandrel 80 moves downwardly relative to housing 62 such that outer rings 110 of layer 112 of energy absorbing members 106 contact shoulder 78, shearable members 108 begin to deform thereby absorbing this shock. Before shearable members 108 of layer 112 are completely deformed, outer rings 110 of layer 112 contact outer rings 110 of layer 114 allowing for a smooth energy absorbing process. Energy absorbing members 106 continue to absorb the shock up to the maximum travel of mandrel 80 relative to housing 62 as best seen in FIG. 5. Again, it should be noted by those skilled in the art that the number of energy absorbing members 106 as well as the number and strength of shearable members 108 may be selected based upon the expected shock to be absorbed. Further, it should be noted that housing 62 and mandrel 80 may be allowed to rotate relative to one another or such rotation may be prevented using an anti-rotation lock or the like.

While FIGS. 2–5 have depicted a shock absorber of the present invention that is intended to take a major shock in one direction, mandrel 80 moving upwardly relative to housing 62, and a minor shock in the other direction, mandrel 80 moving downwardly relative to housing 62, it should be understood by those skilled in the art that the shock absorber of the present invention could alternatively be configured to take a major shock regardless of the relative longitudinal direction of movement between mandrel 80 and housing 62.

Figure 6:
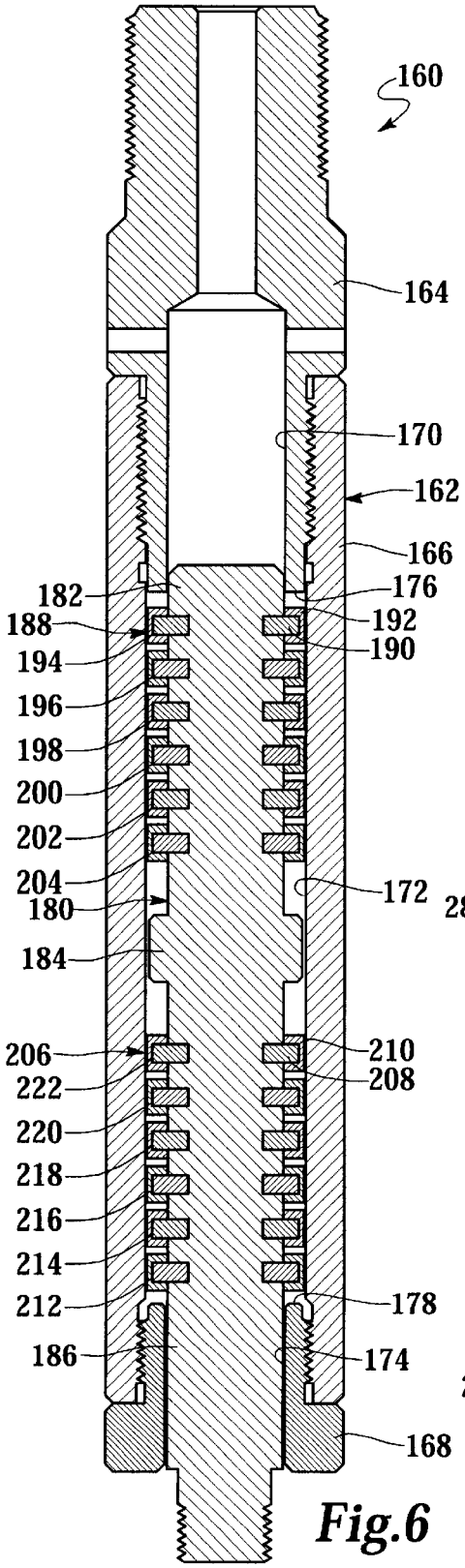
FIG. 6 is a half sectional view of another embodiment of an apparatus for absorbing a shock of the present invention before a shock has been absorbed.

For example, and now referring to FIG. 6, therein is depicted a shock absorber of the present invention that is generally designated 160. Shock absorber 160 includes an axially extending, generally tubular outer housing 162. Outer housing 162 includes an upper connector 164 that is threadably attachable to another tool (not pictured). Outer housing 162 also includes a primary housing section 166 that is threadably coupled to upper connector 164. Threadably attached to the lower end of primary housing section 166 is an end cap 168. A longitudinal bore is defined within outer housing 162. Specifically, upper connector 164 defines upper bore 170, primary housing section 166 defines primary bore 172 and end cap 168 defines lower bore 174. Upper bore 170 and lower bore 174 have radially reduced inner diameters compared with primary bore 172. At the lower end of upper connector 164 is a shoulder 176 that separates upper bore 170 and primary bore 172. Likewise, at the upper end of end cap 168 is a shoulder 178 that separates lower bore 174 from primary bore 172.

Slidably positioned within outer housing 162 is an axially extending, generally tubular mandrel 180. Mandrel 180 includes an upper section 182 that is slidably received within upper bore 170 of outer housing 162. Mandrel 180 also includes an intermediate section 184 that is slidably received within primary bore 172 of outer housing 162. Mandrel 180 further includes a lower section 186 that is slidably received within lower bore 174 of outer housing 162 and may be threadably attached to another tool (not pictured). Extending radially outwardly from upper section 182 of mandrel 180 is a plurality of energy absorbing members 188 that include shearable members 190 and outer rings 192.

Energy absorbing members 188 are positioned longitudinally along upper section 182 of mandrel 180 in a layer arrangement including layers 194–204. Accordingly, each layer 194–204 may include a plurality of shearable members or a single shearable member. Even though FIG. 6 has been depicted as having six layers 194–204, it should be understood by those skilled in the art that any number of layers of energy absorbing members 188 could alternatively be utilized those numbers being either greater than or less than six.

Extending radially outwardly from lower section 186 of mandrel 180 are additional energy absorbing members 206 that may be identical to energy absorbing members 188. Specifically, energy absorbing members 206 include shearable members 208 that may be shear pins or shear rings and outer rings 210. Energy absorbing members 206 are oriented longitudinally along lower section 186 of mandrel 180 in layers 212–222. Again, it should be noted by those skilled in the art that any number of layers of energy absorbing members 206 could alternatively be utilized those numbers being either greater than or less than six.

Shock absorber 160 is configured to absorb a major shock regardless of the relative longitudinal direction of movement between mandrel 180 and housing 162. Assuming the rating of shearable members 190 and shearable members 208 is the same, shock absorber 160 can absorb the same shock whether mandrel 180 moves upwardly relative to housing 162 or downwardly relative to housing 162. It should be understood by those skilled in the art, however, that shearable members 190 may have different ratings than shearable members 208 and there may be a different number of layers of energy absorbing members 188 as compare to energy absorbing members 206, as seen above in FIGS. 2–5.

Figure 7:
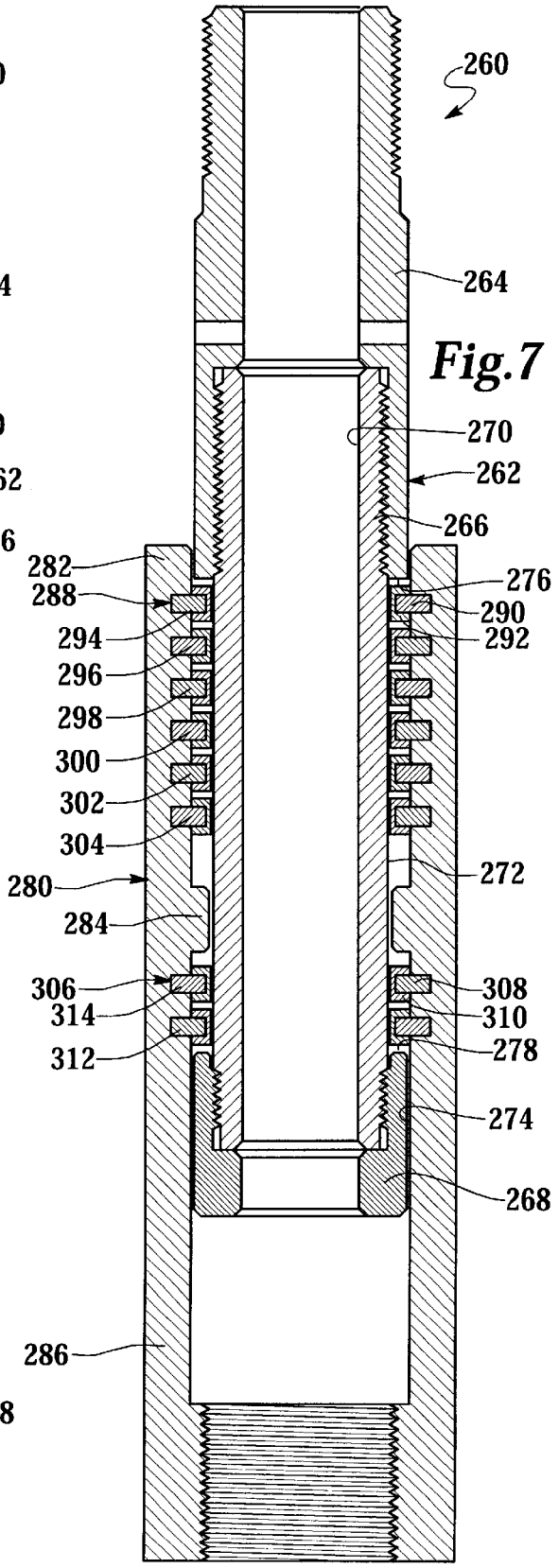
FIG. 7 is a half sectional view of another embodiment of an apparatus for absorbing a shock of the present invention before a shock has been absorbed.

In some shock absorbing applications, it is important to have access through a shock absorber. Accordingly, as best seen in FIG. 7, therein is depicted a shock absorber of the present invention having a full bore that is generally designated 260. Shock absorber 260 includes an axially extending, generally tubular housing 262. Housing 262 includes an upper connector 264 that is threadably attachable to another tool (not pictured). Housing 262 also includes a primary housing section 266 that is threadably coupled to upper connector 264. Threadably attached to the lower end of primary housing section 266 is an end cap 268. A longitudinal bore 270 is defined within housing 262 that allows other tools to pass therethrough. A radially reduced outer diameter 272 is defined along primary housing section 266 between shoulder 276 of upper connector 264 and shoulder 278 of end cap 268.

Slidably positioned about housing 262 is an axially extending, generally tubular sleeve 280. Sleeve 280 includes an upper section 282 that is slidable around upper connector 264 of housing 262. Sleeve 280 also includes an intermediate section 284 that is slidably positioned around primary housing section 266 of housing 262. Sleeve 280 further includes a lower section 286 that is slidable around end cap 268 of housing 262 and is threadably attachable to another tool (not pictured). Extending radially inwardly from upper section 282 of sleeve 280 is a plurality of energy absorbing members 288 that include shearable members 290 and outer rings 292.

Energy absorbing members 288 are positioned longitudinally along upper section 282 of sleeve 280 in a layer arrangement including layers 294–304. Accordingly, each layer 294–304 may include a plurality of shearable members or a single shearable member. Likewise, extending radially inwardly from lower section 286 of sleeve 280 are additional energy absorbing members 306 that may be identical to energy absorbing members 288. Specifically, energy absorbing members 306 include shearable members 308 that may be shear pins or shear rings and outer rings 310. Energy absorbing members 306 are oriented longitudinally along lower section 286 of sleeve 280 in layers 312, 314. According, using shock absorber 260 of the present invention, other tools or equipment may pass through longitudinal bore 270. Also, it should be noted that housing 262 and sleeve 280 may be allowed to rotate relative to one another or such rotation may be prevented using an anti-rotation lock or the like if desired.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An apparatus for absorbing a shock downhole comprising:

a first tubular member disposed downhole;

a second tubular member slidably positioned relative to the first tubular member; and a plurality of layers of energy absorbing members extending radially from the second tubular member such that movement of the second tubular member in a first direction relative to the first tubular member sequentially deforms the layers of energy absorbing members, thereby absorbing the shock downhole.

2. The apparatus as recited in claim 1 wherein the second tubular member is positioned interiorly of the first tubular member.

3. The apparatus as recited in claim 1 wherein the second tubular member is positioned exteriorly of the first tubular member.

4. The apparatus as recited in claim 1 wherein the energy absorbing members are positioned between the first and second tubular members.

5. The apparatus as recited in claim 1 wherein the energy absorbing members extend radially outwardly from the second tubular member.

6. The apparatus as recited in claim 1 wherein the energy absorbing members extend radially inwardly from the second tubular member.

7. The apparatus as recited in claim 1 wherein each layer of energy absorbing members further comprises a plurality of shear pins.

8. The apparatus as recited in claim 1 wherein each layer of energy absorbing members further comprises a shear ring.

9. The apparatus as recited in claim 1 wherein a subsequent layer of energy absorbing members begins to deform before a previous layer of energy absorbing members is completely deformed when the second tubular member moves in the first direction relative to the first tubular member.

10. An apparatus for absorbing a shock comprising:

a first tubular member;

a second tubular member slidably positioned relative to the first tubular member; and a plurality of layers of energy absorbing members extending radially from the second tubular member such that movement of the second tubular member in a first direction relative to the first tubular member sequentially deforms the layers of energy absorbing members, wherein a subsequent layer of energy absorbing members begins to deform before a previous layer of energy absorbing members is completely deformed, thereby absorbing the shock.

11. The apparatus as recited in claim 10 wherein the second tubular member is positioned interiorly of the first tubular member.

12. The apparatus as recited in claim 10 wherein the second tubular member is positioned exteriorly of the first tubular member.

13. The apparatus as recited in claim 10 wherein the energy absorbing members are positioned between the first and second tubular members.

14. The apparatus as recited in claim 10 wherein the energy absorbing members extend radially outwardly from the second tubular member.

15. The apparatus as recited in claim 10 wherein the energy absorbing members extend radially inwardly from the second tubular member.

16. The apparatus as recited in claim 10 wherein each layer of energy absorbing members further comprises a plurality of shear pins.

17. The apparatus as recited in claim 10 wherein each layer of energy absorbing members further comprises a shear ring.

18. An apparatus for absorbing a shock comprising:

a first tubular member;

a second tubular member slidably positioned relative to the first tubular member; and a plurality of layers of energy absorbing members extending radially inwardly from the second tubular member such that longitudinal movement of the second tubular member relative to the first tubular member sequentially deforms the layers of energy absorbing members, thereby absorbing the shock.

19. The apparatus as recited in claim 18 wherein the second tubular member is positioned exteriorly of the first tubular member.

20. The apparatus as recited in claim 18 wherein the energy absorbing members are positioned between the first and second tubular members.

21. The apparatus as recited in claim 18 wherein each layer of energy absorbing members further comprises a plurality of shear pins.

22. The apparatus as recited in claim 18 wherein each layer of energy absorbing members further comprises a shear ring.

23. The apparatus as recited in claim 18 wherein a subsequent layer of energy absorbing members begins to deform before a previous layer of energy absorbing members is completely deformed when the second tubular member moves longitudinally relative to the first tubular member.

24. An apparatus for absorbing a shock comprising:

a first tubular member;

a second tubular member slidably positioned relative to the first tubular member; and first and second pluralities of layers of energy absorbing members extending radially from the second tubular member such that longitudinal movement of the second tubular member relative to the first tubular member in either direction sequentially deforms the layers of energy absorbing members of one of the first and second pluralities of layers of energy absorbing members, thereby absorbing the shock.

25. The apparatus as recited in claim 24 wherein the second tubular member is positioned interiorly of the first tubular member.

26. The apparatus as recited in claim 24 wherein the second tubular member is positioned exteriorly of the first tubular member.

27. The apparatus as recited in claim 24 wherein the energy absorbing members are positioned between the first and second tubular members.

28. The apparatus as recited in claim 24 wherein the energy absorbing members extend radially outwardly from the second tubular member.

29. The apparatus as recited in claim 24 wherein the energy absorbing members extend radially inwardly from the second tubular member.

30. The apparatus as recited in claim 24 wherein each layer of energy absorbing members further comprises a plurality of shear pins.

31. The apparatus as recited in claim 24 wherein each layer of energy absorbing members further comprises a shear ring.

32. The apparatus as recited in claim 24 wherein a subsequent layer of energy absorbing members begins to deform before a previous layer of energy absorbing members is completely deformed when the second tubular member moves longitudinally relative to the first tubular member.

33. An apparatus for absorbing a shock comprising:

an outer housing having first and second interior portions, the second interior portion being radially reduced relative to the first interior portion, a shoulder being formed therebetween;

a mandrel slidably positioned within the outer housing; and a plurality of layers of shearable members extending radially outwardly from the mandrel toward the first interior portion of the outer housing such that longitudinal movement of the mandrel in a first direction relative to the outer housing contacts one of the layers of deformable members with the shoulder which sequentially deforms the layers of shearable members, thereby absorbing the shock.

34. The apparatus as recited in claim 33 wherein each layer of energy absorbing members further comprises a plurality of shear pins.

35. The apparatus as recited in claim 33 wherein each layer of energy absorbing members further comprises a shear ring.

36. An apparatus for absorbing a shock comprising:

a housing having first and second exterior portions, the first exterior portion being radially reduced relative to the second exterior portion, a shoulder being formed therebetween;

a mandrel slidably positioned around the housing; and a plurality of layers of shearable members extending radially inwardly from the mandrel toward the first exterior portion of the housing such that longitudinal movement of the mandrel in a first direction relative to the housing contacts one of the layers of deformable members with the shoulder which sequentially deforms the layers of shearable members, thereby absorbing the shock.

37. The apparatus as recited in claim 36 wherein each layer of energy absorbing members further comprises a plurality of shear pins.

38. The apparatus as recited in claim 36 wherein each layer of energy absorbing members further comprises a shear ring.

39. A method for absorbing a shock downhole comprising:

slidably positioning a first tubular member relative to a second tubular member downhole;

radially extending a plurality of layers of energy absorbing members from the second tubular member; and sequentially deforming the layers of energy absorbing members as the second tubular member is moved in a first direction relative to the first tubular member, thereby absorbing the shock downhole.

40. The method as recited in claim 39 wherein the step of slidably positioning a first tubular member relative to a second tubular member further comprises the step of slidably positioning the first tubular member interiorly of the second tubular member.

41. The method as recited in claim 39 wherein the step of slidably positioning a first tubular member relative to a second tubular member further comprises the step of slidably positioning the first tubular member exteriorly of the second tubular member.

42. The method as recited in claim 39 wherein the step of radially extending a plurality of layers of energy absorbing members from the second tubular member further comprises positioning the energy absorbing members between the first and second tubular members.

43. The method as recited in claim 39 wherein the step of radially extending a plurality of layers of energy absorbing members from the second tubular member further comprises extending the energy absorbing members radially outwardly from the second tubular member.

44. The method as recited in claim 39 wherein the step of radially extending a plurality of layers of energy absorbing members from the second tubular member further comprises extending the energy absorbing members radially inwardly from the second tubular member.

45. The method as recited in claim 39 wherein each layer of energy absorbing members further comprises a plurality of shear pins.

46. The method as recited in claim 39 wherein each layer of energy absorbing members further comprises a shear ring.

47. The method as recited in claim 39 wherein the step of sequentially deforming the layers of energy absorbing members further comprises beginning to deform a subsequent layer of energy absorbing members before a previous layer of energy absorbing members is completely deformed when the second tubular member moves in the first direction relative to the first tubular member.

48. A perforating gun assembly comprising:

a perforating gun; and a shock absorber operably associated with the perforating gun, the shock absorber including a first tubular member, a second tubular member slidably positioned relative to the first tubular member and a plurality of layers of energy absorbing members extending radially from the second tubular member such that movement of the second tubular member in a first direction relative to the first tubular member sequentially deforms the layers of energy absorbing members, thereby absorbing a shock.

49. A downhole tool assembly comprising:

a work string;

a perforating gun; and a shock absorber, the shock absorber including a first tubular member operably associated with the work string and a second tubular member slidably positioned relative to the first tubular member and operably associated with the perforating gun, the shock absorber having a plurality of layers of energy absorbing members extending radially from the second tubular member such that movement of the second tubular member in a first direction relative to the first tubular member sequentially deforms the layers of energy absorbing members, thereby absorbing a shock.

* * * * *